US007894928B2

(12) United States Patent
Puget et al.

(10) Patent No.: US 7,894,928 B2
(45) Date of Patent: Feb. 22, 2011

(54) DEVICE FOR FORMING A JACQUARD TYPE SHED, A LOOM FITTED WITH SUCH A DEVICE, AND A METHOD OF FORMING THE SHED ON SUCH A LOOM

(75) Inventors: Sylvain Puget, Seythenex (FR); Raphael Peuget, Pontcharra (FR); Walter Marsura, Faverges (FR)

(73) Assignee: Staubli Faverges, Faverges (FR)

( * ) Notice: Subject to any disclaimer, the term of this patent is extended or adjusted under 35 U.S.C. 154(b) by 930 days.

(21) Appl. No.: 11/808,076

(22) Filed: Jun. 6, 2007

(65) Prior Publication Data

US 2007/0293976 A1 Dec. 20, 2007

(30) Foreign Application Priority Data

Jun. 16, 2006 (FR) ..... 06 05379

(51) Int. Cl.
*G06F 19/00* (2006.01)

(52) U.S. Cl. ..... 700/140; 139/59; 139/455

(58) Field of Classification Search ..... 700/130, 700/131, 140; 139/55.1, 59, 455
See application file for complete search history.

(56) References Cited

U.S. PATENT DOCUMENTS 4,364,002 A * 12/1982 Suzuki et al. ..... 139/1 E
4,556,945 A * 12/1985 Fry ..... 700/140
5,070,913 A 12/1991 Palmer ..... 139/319
5,183,081 A * 2/1993 Kuster et al. ..... 139/59
5,355,911 A * 10/1994 Kuster et al. ..... 139/55.1
5,743,305 A * 4/1998 Tamura et al. ..... 139/1 E
6,293,315 B1 * 9/2001 Froment et al. ..... 139/55.1
6,357,486 B2 * 3/2002 Braun ..... 139/59
6,834,681 B2 * 12/2004 Wahhoud ..... 139/1 E
2003/0070721 A1 4/2003 Wahhoud

FOREIGN PATENT DOCUMENTS

EP 0353005 B1 3/1995
EP 1065306 A2 1/2001
EP 1559816 A2 8/2005
WO WO 90/01081 2/1990

* cited by examiner

*Primary Examiner*—Danny Worrell
(74) *Attorney, Agent, or Firm*—Dowell & Dowell P.C.

(57) ABSTRACT

A device for forming a Jacquard type shed including a plurality of electric actuators ($6_1$) and control means ($C_1$, $C_{21}$) for controlling each actuator ($6_1$) suitable for generating a signal ($S_{211}$) representative of a value of at least one parameter (A). The control means includes an analyzer ($C'_{21}$) for analyzing, for at least one pick ($d_n$), a design that corresponds to one or more picks. The control means also includes a unit ($C''_{21}$) for determining a modification factor on the basis of the result of the analysis carried out by the analyzer ($C'_{21}$), in order to modify the value of the parameter (A) as determined by a computer.

20 Claims, 4 Drawing Sheets

DEVICE FOR FORMING A JACQUARD TYPE SHED, A LOOM FITTED WITH SUCH A DEVICE, AND A METHOD OF FORMING THE SHED ON SUCH A LOOM

BACKGROUND OF THE INVENTION

1. Field of the Invention

The invention relates to a device for forming a Jacquard type shed for a loom, and to a loom fitted with such a device. The invention also relates to a method of forming the shed on such a loom.

2. Brief Description of the Related Art

In the field of forming sheds, WO-A-90/01081 discloses electrical control of electric actuators in a Jacquard type loom. EP-A-1 559 816 discloses using computers controlling electric actuators that enable the cords of a Jacquard harness to be moved in order to control displacement of heddles between a high position and a low position, thus enabling the shed to be formed for each pick. A Jacquard harness may have more than 12,000 individually-controlled cords in order to produce a design having more than 20,000 picks.

The shed is defined as the path followed by the heddles over time, so the shed parameters can be the amplitude of the movement, its shape, its offset in time relative to a reference that may be the crossing or its vertical offset relative to a reference plane, possibly the sheet of the yarns at the crossing. When it is appropriate to modify the shed parameters, the weaver needs to proceed with very numerous adjustments of these parameters which adjustments are lengthy, fiddly, and consequently, a source of errors.

SUMMARY OF THE INVENTION

The invention seeks more particularly to remedy those drawbacks by proposing a novel shed-forming device that simplifies very considerably the programming work to be carried out by the weaver when a new design is to be implemented on a loom, or when the shed parameters need to be modified.

To this end, the invention relates to a device for forming a Jacquard type shed, this device having a plurality of electric actuators and control means for controlling the actuators and suitable for generating, for each actuator, a signal representative of the value of at least one parameter determined by a computer. The device is characterized in that the control means comprise, for at least one actuator:

- an analyzer suitable for analyzing automatically, for one pick, the design corresponding to one or more picks; and
- a unit for determining a modification factor on the basis of the result of the analysis carried out by the analyzer, for modifying the value of the parameter determined by the computer.

In the meaning of the present invention, a pick corresponds to one weft insertion cycle. The design defines the fabric. It contains at least the weave of the design, and optionally other elements such as information relating to the type of weft to be inserted on each pick. The weave of a fabric defines the position of the or each yarn as controlled by each actuator relative to the weft, and for each pick. The weave is conventionally represented by a table in which the columns corresponds to the actuators and the rows to the picks. A cell is blackened or marked with a cross to indicate that the yarn(s) controlled by the actuator of that column pass above the weft for the pick under consideration in a row. Conversely, a white cell means that the yarn(s) controlled by the actuator pass under the weft for the pick in question. From a computer point of view, the positions of the yarns controlled by an actuator can be stored as one bit per pick. The bit takes the value 1 when a controlled yarn is to lie above the weft and the value 0 when a yarn is to lie under it.

A pick lasts for one stroke of the loom, i.e. 360° of rotation of the main shaft of the loom. At the beginning of a pick, the moving yarns are at the crossing, i.e. substantially in the vicinity of a midplane of the shed. They reach their extreme, high or low positions when the angle of the loom has turned through about 180° relative to the beginning of the pick.

By means of the invention, the analyzer and the unit for determining the modification factor make it possible automatically, i.e. without human intervention, to obtain dynamic adaptation of a control parameter of an actuator, thereby avoiding any need for the weaver to program each actuator or group of actuators individually.

According to aspects of the invention that are advantageous but not essential, such a device may incorporate one or more of the characteristics of claims 2 to 6:

The invention also provides a method of forming the shed on a loom, the method being suitable for implementing with the above-mentioned device. In this method, the harness cords of a Jacquard type weaving mechanism are controlled by means of a plurality of electric actuators controlled by means suitable for generating, for each actuator, a signal representative of the value of a calculated parameter. The method is characterized in that it comprises automatic steps consisting, for at least one pick:

a) in analyzing, for at least one actuator, the design corresponding to one or more picks; and b) in optionally modifying the value of at least one control parameter for controlling the actuator as a function of the result of the analysis of step a).

By means of the invention, for an actuator it is possible to take account of the design corresponding to one or more picks in order to adjust automatically one of the control parameters of that actuator. In other words, the method of the invention consists in dynamically modifying the shed by appropriately controlling the actuators.

According to aspects of the invention that are advantageous but not essential, such a method may incorporate one or more of the characteristics of claims 8 to 18:

Finally, the invention provides a loom provided with a shed-forming device as mentioned above, such a loom being easier and less expensive to operate than looms of the state of the art.

BRIEF DESCRIPTION OF THE DRAWINGS

The invention can be better understood and other advantages thereof appear more clearly in the light of the following description of an embodiment of a shed-forming device, of a loom, and of a plurality of methods in accordance with the principle of the invention, given purely by way of example and made with reference to the accompanying drawings, in which.

DESCRIPTION OF THE PREFERRED EMBODIMENTS

Figure 1:
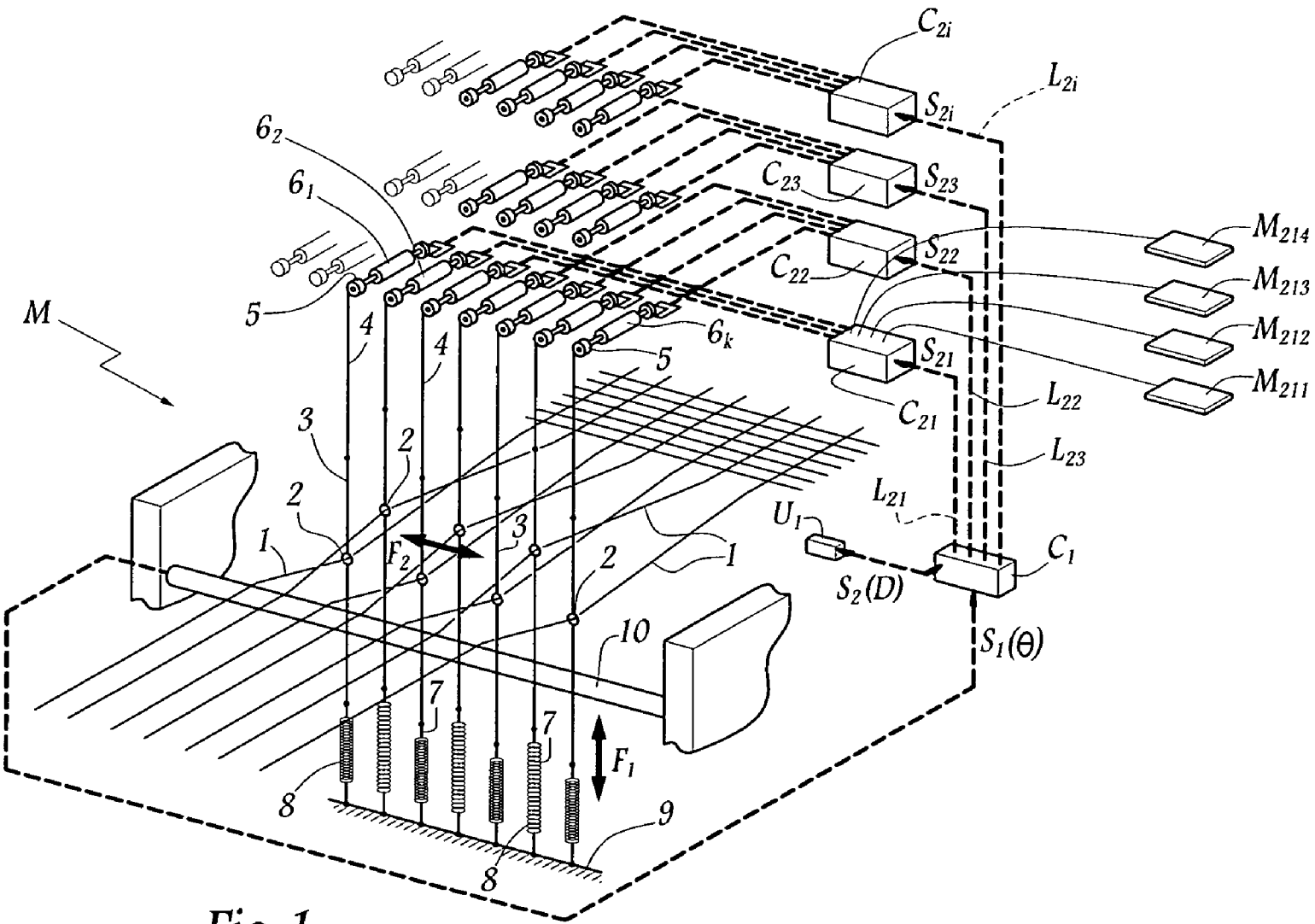
FIG. 1 is a diagrammatic view showing the principles of a loom in accordance with the invention that incorporates a shed-forming device in accordance with the invention.

The loom M shown diagrammatically in FIG. 1 is fitted with warp yarns 1 each passing through an eyelet 2 of a heddle 3 driven with vertical reciprocating movement represented by double-headed arrow $F_1$, this movement being generally perpendicular to the direction in which the weft yarns are engaged in the shed, this direction being represented by double-headed arrow $F_2$. Each heddle is connected by a cord 4 to a pulley 5 that is driven in rotation by an electric servo-motor 6 forming an actuator for the pulley 5. In its bottom portion, each heddle 3 is connected by a rod 7 to a return spring 8 secured to the structure 9 of the loom M.

In practice, the number of actuators 6 in the loom M may be 12,000 or more.

In order to control all or some of the actuators 6, a central computer $C_1$ is used, together with a plurality of remote computers $C_{21}, C_{22}, C_{23}, \ldots, C_{2i}$, where i has a value adapted to the number of actuators 6. Each computer $C_{21}$ or equivalent computer is located close to the servo-motors 6 that it controls. The computer $C_{21}$ and the equivalent computers are connected to the central computer $C_1$ over dedicated electrical connections $L_{21}, L_{22}, L_{23}, \ldots, L_{2i}$. The computer $C_1$ receives a signal $S_1$ representative of the instantaneous position of the shaft of the loom M in its cycle. This signal corresponds to the instantaneous position of its main shaft 10 and can be measured by its angular position θ relative to a reference position.

The computer $C_1$ is connected to an electronic unit $U_1$ in which data is stored relating to the design, including information about the desired weave, i.e. the pattern to be made during weaving. Depending on the design D to be made, the computer $C_1$ receives from the unit $U_1$ a signal $S_2$ representative of the design.

Figure 3A:
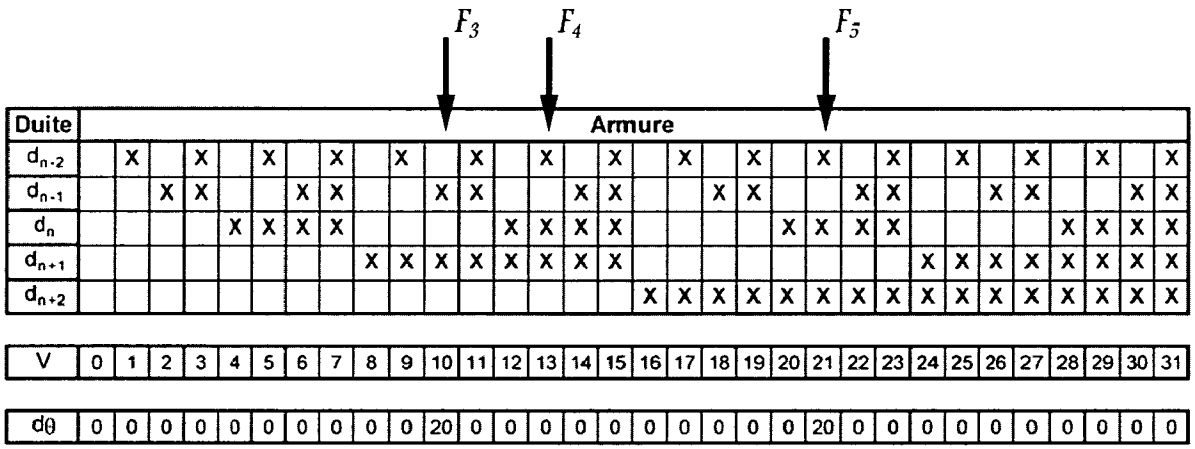
FIG. 3A is a table showing the various types of weave that are possible for a series of five picks, together with the numerical values associated therewith in the context of the invention.
Figure 3B:
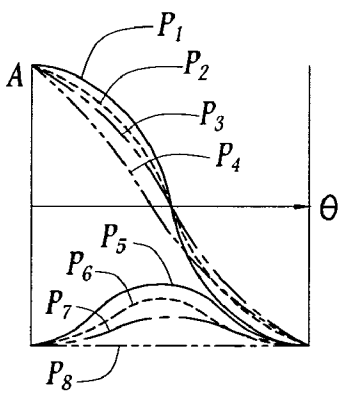
FIG. 3B is a diagram showing different types of profile used for calculating the actuator control parameters.

The computer $C_{21}$ is associated with a memory $M_{211}$ forming a library that stores values representative of types of profile $P_1$ to $P_8$ shown in FIG. 3B, or algorithms for calculating these values.

These types of profile $P_1$ to $P_8$ correspond to types of movement in a vertical direction Z-Z' that can be performed by an eyelet 2 as a function of the angular position θ of the main shaft of the loom over time t, said movement corresponding to the direction of double-headed arrow $F_1$. The types of profile $P_1$, $P_2$, $P_3$, and $P_4$ correspond to an eyelet changing its position relative to the weft, whereas the types of profile $P_5$, $P_6$, $P_7$, and $P_8$ correspond to the eyelet being maintained in position relative to the weft.

Figure 2:
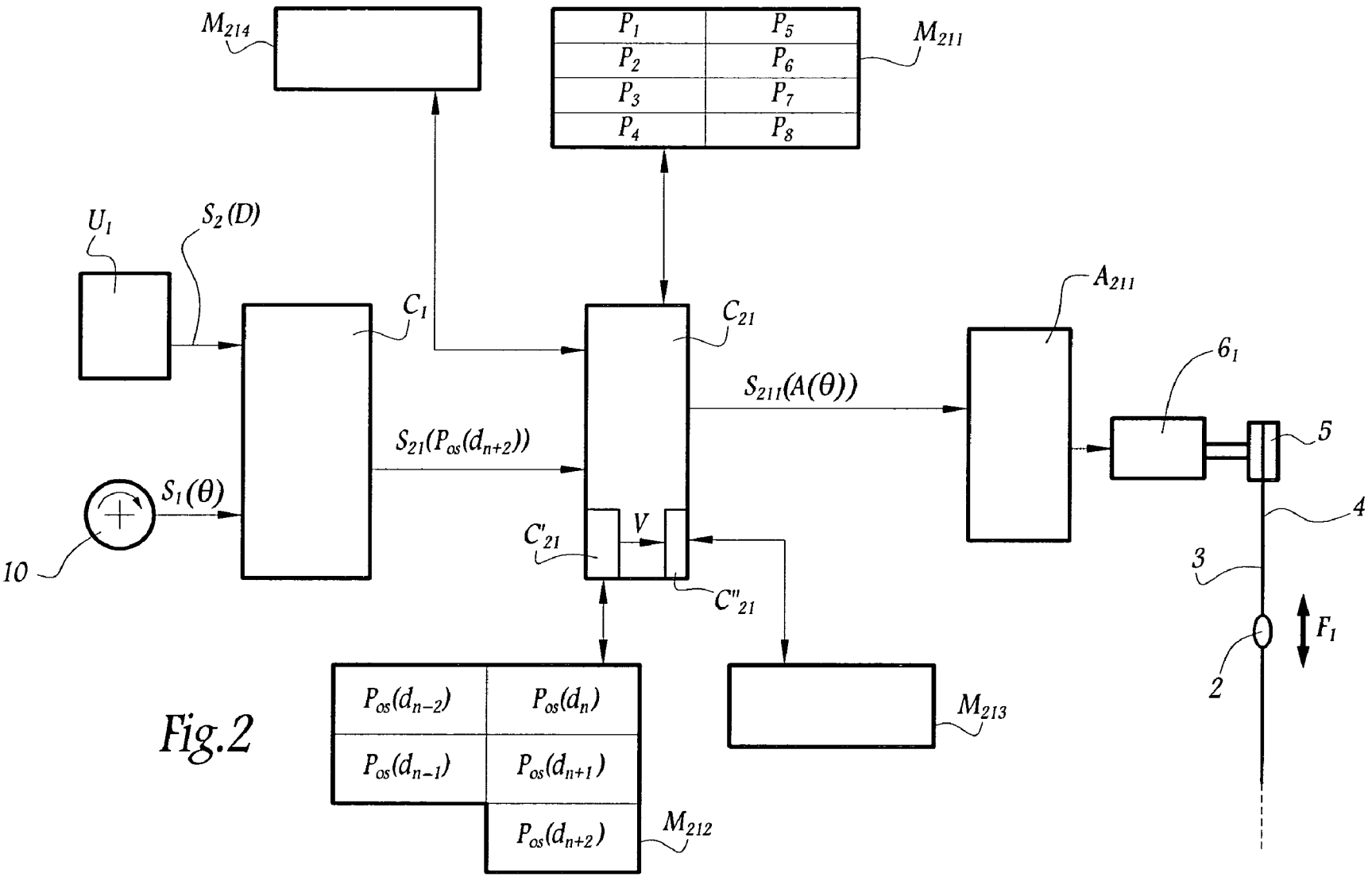
FIG. 2 is a diagrammatic view showing the principles of means for controlling an actuator of the FIG. 1 device.

FIG. 2 shows how the actuator $\mathbf{6}_1$ is controlled, it being understood that the other actuators $\mathbf{6}_2$ to $\mathbf{6}_k$ are controlled by the computer $C_{21}$ in analogous manner.

For each given pick $d_n$, its order number in the succession of picks corresponding to weaving a complete design D is written n, and the computer $C_{21}$ has access to a memory $M_{212}$ storing the positions relative to the weft that are adopted in the two preceding picks, which positions are written respectively Pos ($d_{n-2}$) and Pos ($d_{n-1}$), and also the position relative to the weft to be adopted in the pick in question, which is written Pos ($d_n$), and the positions relative to the weft to be adopted in the following two picks, which are written Pos ($d_{n+1}$) and Pos ($d_{n+2}$). Thus, the computer $C_{21}$ has information about the positions to be occupied in five successive picks, including the current pick, by the heddle 3 that is actuated by the servo-motor $\mathbf{6}_1$. These five positions relative to the weft constitute a so-called "portion" of the weave performed by the loom.

During the operation of a loom M, and when it is necessary to control the servo-motor $\mathbf{6}_1$, at the beginning of a given pick $d_n$, the computer $C_{21}$ receives a signal $S_{21}$ from the computer $C_1$ specifying the position relative to the weft Pos ($d_{n+2}$) that is to be taken by the heddle 3 for the second pick following the pick in question, i.e. the pick referenced $d_{n+2}$.

The values stored in the memory $M_{212}$ are shifted step by step, the value Pos ($d_{n-1}$) taking the value Pos ($d_{n-2}$), and so on.

Memories $M_{214}$ associated with the computer $C_{21}$ also contain:

- the maximum amplitude Amp of the displacement desired for the actuator 61;
- the type of profile Pc desired for a change of position relative to the weft for said actuator;
- the type of profile Pm desired for maintaining position relative to the weft for said actuator;
- the crossing offset Δθ of the profile desired for said actuator; and
- the vertical offset ΔZ of the profile relative to a reference plane, which may be the height of the sheet at the crossing for said actuator.

Amp, Pc, Pm, Δθ, and ΔZ are basic shed parameters for a given actuator 6.

Starting from the weave that is transmitted thereto and from the shed parameters, the computer $C_{21}$ can determine the displacement relationship for the heddle 3 driven by the actuator which it controls for an interval corresponding to the length of a pick. This interval begins at 180° from the beginning of the pick and it terminates at 540° from said beginning.

In practice, the setpoint position for each actuator is calculated in the computer $C_{21}$ for a given period Δt. In other words, the setpoint value $K_1, \ldots, K_k$ for each actuator $\mathbf{6}_1, \mathbf{6}_2, \ldots, \mathbf{6}_k$ is a succession of instantaneous setpoint values. Each setpoint value $K_1, \ldots, K_k$ as calculated in this way is then input in the form of a signal $S_{211}, \ldots, S_{21k}$ in a control unit $A_{211}, \ldots, A_{21k}$ dedicated respectively to controlling each actuator $\mathbf{6}_1$, $\mathbf{6}_2, \ldots, \mathbf{6}_k$.

The calculator $C_{21}$ proceeds by analyzing the weave which enables it to determine the values of the shed parameters that are for transmitting in the form of a signal $S_{211}$ to a control unit $A_{211}$ of the servo-motor $\mathbf{6}_1$.

This analysis is performed automatically, i.e. without human intervention, on the five picks centered on $d_n$ and having respective positions contained in the memory $M_{212}$.

Returning to FIG. 3A where the cells or boxes marked with an "X" correspond to positions in which a heddle is located in the upper sheet of the shed, whereas blank cells correspond to circumstances in which a heddle is disposed in the lower sheet of the shed, it can be seen that the movement combinations between the high and low positions of the heddles number 32 when five successive positions of a heddle are taken into consideration.

From a computing point of view, the positions Pos ($d_{n-2}$), Pos ($d_{-1}$), Pos ($d_n$), Pos ($d_{n+1}$), and Pos ($d_{n+2}$) relative to the weft of the yarns controlled by any one actuator are encoded on a single bit. This bit takes the value 1 when the control yarn is to be above the weft and the value 0 when it is to be below the weft. To distinguish between the thirty-two different combinations of positions, and with respect to a shed $d_n$, Pos ($d_{n-2}$), Pos ($d_{n-1}$), Pos ($d_n$), Pos ($d_{n+1}$), and Pos ($d_{n+2}$) are concatenated to form a 5-bit binary word. Under such conditions, each combination of five cells present in a column in the top portion of FIG. 3A can be associated with a binary value. For example, the column marked by arrow $F_3$ can be associated with the binary value 01010 that is equivalent to decimal value 10.

Similarly, the column identified by arrow $F_4$ may be associated with decimal value 13.

Figure 5:
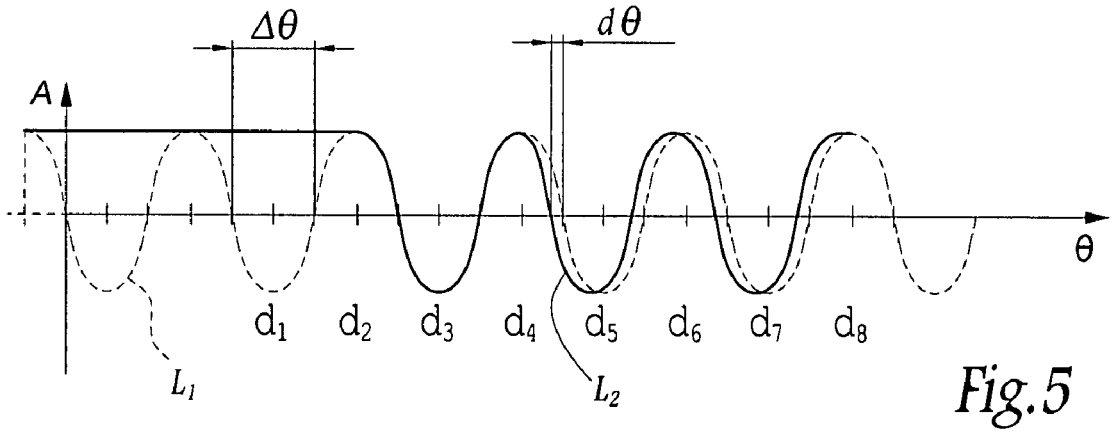
FIG. 5 is a diagrammatic view showing the principles of heddle displacements as a function of the angular position of the shaft of the loom during weaving, while implementing the method of FIG. 4.

In FIG. 5, the movement relationship for the heddle 3 actuated by the servo-motor $\mathbf{6}_1$ is shown as a function of the angle θ of the main shaft of the loom. The value Δθ in the figure corresponds to 360° of rotation of the shaft, i.e. to one pick. For clarity in the present description, the dashed line $L_1$ represents the movement relationship for a heddle performing a taffeta weave, and it enables the cycles of the loom M to be visualized.

Under the circumstances represented by the continuous line in FIG. 5, the heddle is maintained in the high position during the first four revolutions of the loom and then alternates between a high position and a low position with a taffeta movement, starting from the fifth revolution of the loom.

The warp shrinkage of a warp yarn is defined as the difference between its length when it is extracted from the fabric and the length of the fabric. The warp shrinkage of a warp yarn in a taffeta is greater than the warp shrinkage of a warp yarn in a five-harness satin wave for which the weave sequences in binary are 01111, 10111, 11011, 11101, and 11110. If two warp yarns come from the same beam, then the warp shrinkage differences due to the different weaves followed by the warp yarns can lead to defects in appearance. To reduce these differences, it is possible to offset the crossings of the warp yarns, in particular by advancing the crossing of yarns that are weaving a taffeta compared with yarns that are weaving a five-harness satin weave. Under such circumstances, the stroke of the pattern is more effective.

Under these conditions, and as shown in FIG. 5, the movement of the heddle 3 as represented by the continuous line $L_2$ is modified so that it follows a curve that is offset relative to the sinewave $L_1$.

If consideration is given to the fourth pick $d_4$, for which it is possible to define values corresponding to the two preceding picks $d_2$ and $d_3$ and for the two following picks $d_5$ and $d_6$, then the curve $L_2$ crosses the midplane of the shed, i.e. reaches the crossing, at an angle θ that is less, by a value of 20°, than the value at which it would have crossed the midplane by following line $L_2$.

In other words, the weaver can associate with each value V, an offset dθ corresponding to an advance of the crossing when the succession of picks $d_{n-2}$, $d_{n-1}$, $d_n$, $d_{n+1}$, and $d_{n+2}$ corresponds to a taffeta, i.e. to the configuration of columns identified by arrows $F_3$ and $F_5$ in FIG. 3A.

As shown in FIG. 3A, it suffices for the weaver to determine the relationship between the line of values V and the line of corresponding offsets dθ, for this relationship to be implemented automatically on each pick by the computer $C_{21}$. In practice, a table corresponding to the last two lines of FIG. 3A is stored in a memory $M_{213}$ to which the computer $C_{21}$ has access, as shown in FIG. 2.

Figure 4:
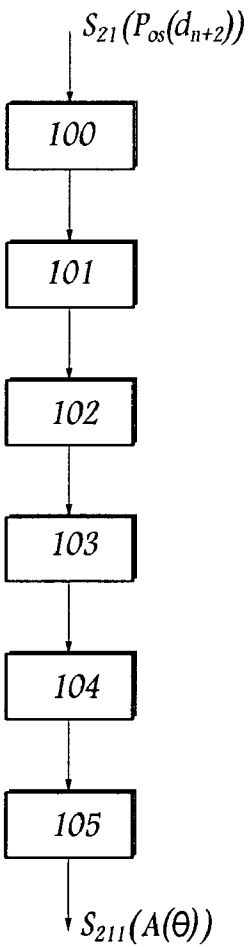
FIG. 4 is a block diagram representing a first method in accordance with the invention.

The operation of the computer $C_{21}$ for controlling the actuator $\mathbf{6}_1$ of a pick $d_n$, follows the flowchart given in FIG. 4. In a preparatory step 100, the computer $C_{21}$ receives the signal $S_{21}$ from the computer $C_1$. In a first step 101, the value of the position Pos ($d_{n+2}$) for the pick $d_{n+2}$ is stored in the memory $M_{212}$. In a second step 102, the computer accesses the memory $M_{212}$ and retrieves the information relating to the positions Pos ($d_{n-2}$), Pos ($d_{n-1}$), Pos ($d_n$), Pos ($d_{n+1}$), and Pos ($d_{n+2}$) for the picks $d_{n-2}$, $d_{n-1}$, $d_n$, $d_{n+1}$, and $d_{n+2}$. In a third step 103, on the basis of this information and on the basis of a table of the-kind shown in FIG. 3A, the computer $C_{21}$ makes use of the values 0 or 1 associated with each of the picks $d_{n-2}$, $d_{n-1}$, $d_n$, $d_{n+1}$, and $d_{n+2}$ to calculate a value V corresponding to one of the columns of FIG. 3A. In other words, by analyzing the portion of the design that corresponds to the actuator $\mathbf{6}_1$ for the pick $d_n$, for the two earlier picks, and for the two later picks, a value V is calculated in step 103. In step 104, the memory $M_{213}$ is accessed, and on the basis of the calculated value for V, it is determined what value should be given to the angular offset dθ in order to implement the crossing.

Once this angular offset value has been determined, the signal $S_{211}$ is generated in a step 105 that corresponds to the values of the amplitude A to be followed as a function of the angle θ. In other words, in step 105, the portion of the curve $L_2$ is generated that corresponds to the interval extending from 180° to 540° after the beginning of the pick $d_n$, possibly after correcting it by the factor dθ for the angle at which the heddle performs the crossing. The correction to the portion of the curve $L_2$ is performed optionally, insofar as it is implemented, whenever necessary, in the event that the factor dθ is not zero. Thus, the combination of steps 104 and 105 serves to modify the value of the amplitude A of the displacements to be generated by the actuator $\mathbf{6}_1$ as a function of the angle θ, i.e. to go from the curve $L_1$ to the curve $L_2$ in FIG. 5.

The computer $C_{21}$ can thus be considered as having a first module $C'_{21}$ serving to analyze the design D corresponding to the current pick, to the earlier, and to later picks, and also a second module $C''_{21}$ in which, as a function of the result of said analysis, i.e. as a function of the value for V, the value of an offset dθ is determined for application to the crossing point, this offset being, in fact, a factor for modifying or correcting the successive values as a function of the angle θ given to the amplitude A in FIG. 5. These successive values of the amplitude A as a function of θ are transmitted to the control unit 21 in the form of the signal $S_{211}$, the unit $A_{211}$ then controlling the actuator $\mathbf{6}_1$ as a function of the signal.

According to aspects of the invention that are not shown, the offset dθ may also have a non-zero value when the value of V is different from 10 and 21. For example, the value of dθ may be equal to 10° when V is equal to 2, 4, 5, 6, 8, 9, 11, 12, 13, 14, 17, 18, 20, 22, and 26. This is a selection to be made by the weaver, and the selection can be given as a rule to be followed by all of the picks of the fabric, thereby avoiding time-consuming programming.

In the embodiment described above, the table present in the memory $M_{213}$ can be the same for all of the actuators. Under such circumstances, the weaver need input the values corresponding to one table only, and these values can be used for all of the actuators and for all of the picks. Under such circumstances, the memory $M_{213}$ is common to all of the computers $C_{2i}$ and all of the actuators 6. In a variant, the table present in the memory $M_{213}$ is specific to each actuator or to each group of actuators, for example the actuators that are to weave the selvage of the fabric.

The invention is described above with the method in which account is taken of two picks before and two picks after the current pick. It is applicable with a method in which account is taken of only one earlier and/or only one later pick. It is also applicable to the general case in which account is taken of m picks centered or not centered on the current pick. Under such circumstances, the table present in the memory $M_{213}$ contains $2^m$ values to which a parameter V can be given lying in the range 0 to $2^m$-1.

The invention is described above for circumstances in which an offset dθ is determined that is applied to offsetting the crossing Δθ originally intended for an actuator. The invention also is applicable to modifying another one of the parameters of the shed like Amp, Pc, Pm, or ΔZ.

In the description above, two modules $C'_{21}$ and $C''_{21}$ are identified. In practice, those modules may be constituted by a microprocessor forming the central portion of the computer $C_{21}$, the microprocessor being programmed to act successively as each of the modules $C'_{21}$ and $C''_{21}$, and also to perform other functions of the computer $C_{21}$.

In FIG. 2, the memories $M_{211}$, $M_{212}$, $M_{213}$, and $M_{214}$ are shown as being outside the computer $C_{21}$. In practice, they can be integrated therein. In FIG. 1, to clarify the drawing, only the memories associated with the computer $C_{21}$ are shown.

In a variant of the invention that is not shown, the offset dθ can be calculated in the main computer $C_1$ for each of the actuators. Under such circumstances, the value of the offset is integrated in the signal $S_{21}$.

The invention is described above for circumstances in which a central computer $C_1$ is used together with remote computers $C_{21}, C_{22}, \ldots, C_{2i}$. The invention is also applicable to using a single computer for controlling an actuator 6.

Figure 6:
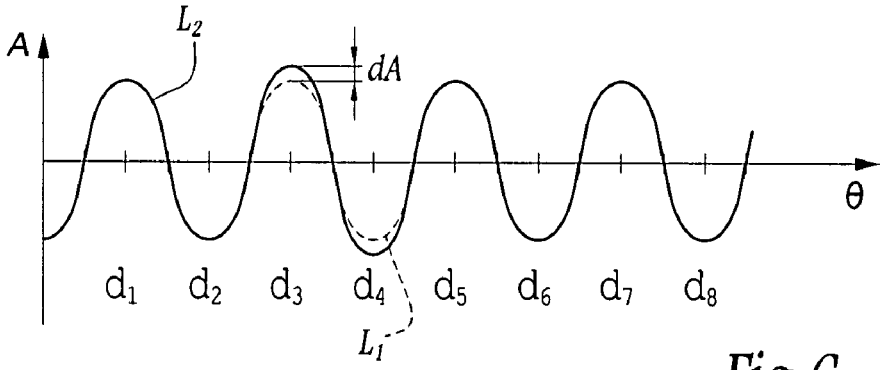
FIG. 6 is a view analogous to FIG. 5, while implementing a second method in accordance with the invention.

The second embodiment of the invention shown in FIG. 6 concerns circumstances in which the shed parameters are modified as a function of analyzing the design D for all of actuators 6 on a single pick.

It is known that the geometry of the open shed depends on the unbalance between the number of yarns disposed respectively in the high position and in the low position. In order to obtain good efficiency and good quality of insertion, in particular on a rapier loom, the geometry of the shed must remain as stable as possible. In order to obtain good shed stability, it is possible to adjust certain parameters of the shed in appropriate manner.

Under such circumstances, and making reference to FIG. 1, the analysis is carried out in the central computer $C_1$ which has access to data relating to all of the actuators 6.

For example, the weaver may input into a memory analogous to the memory $M_{213}$ to which the central computer $C_1$ has access, a value for the over-travel dA to be applied upwards or downwards to each heddle as a function of the unbalance predicted for the shed, in particular as a function of the ratio between the number of yarns in the high position and the number of yarns in the low position intended for a forthcoming shed.

In operation, at the beginning of each pick $d_n$, the computer $C_1$ evaluates the unbalance on the following pick $d_{n+1}$ on the basis of the knowledge it has of the positions of the yarns on said following pick. On the basis of this evaluation, the computer $C_1$ determines the modifications to be made to the corresponding shed parameters, in particular the modifications to be made in the maximum amplitude Amp of the heddle strokes, over an interval extending from 180° to 540° of loom angle following the beginning of pick $d_n$. These modifications are sent to the remote computers $C_{21}, \ldots, C_{2i}$ within the signals $S_{21}, \ldots, S_{2i}$.

Thus, as shown in FIG. 6, the line $L_2$ represents the stroke of a heddle controlled by an actuator 6 as a function of the angle θ of the main shaft 10. It is considered that the picks have respective order numbers $d_1, d_2, d_3, \ldots$. The value of the unbalance of the shed for a pick $d_n$ is defined as corresponding to the ratio of the difference between the number of yarns in the high position and the number of yarns in the low position divided by the total number of yarns. This unbalance can be calculated, for each pick $d_n$ and for all of the actuators 6, by the computer $C_1$. The value calculated for the unbalance can be rounded to within 0.1. This provides one out of eleven values covering the range 0 to 1.

For each actuator 6 and for each pick $d_n$, and as a function of the value of the unbalance predicted for pick $d_{n+1}$, it is determined what corrective action needs to be applied to the maximum amplitude Amp of the stroke of the heddle, in the form of positive or negative over-travel dA that makes it possible to compensate at least in part for the unbalance expected for pick $d_{n+1}$.

The first computer $C_1$ determines the over-travel dA to be applied and sends the corresponding information within the signals $S_{21}, \ldots, S_{2i}$ to each of the remote computers $C_{21}, \ldots, C_{2i}$. The over-travel values dA may differ from one actuator to another.

Each remote computer $C_{21}, \ldots, C_{2i}$ takes account of the over-travel dA when calculating the position setpoints sent to the actuators under its control.

In a variant, instead of applying an over-travel dA and in order to compensate at least in part the expected unbalance for pick $d_{n+1}$, it is possible to envisage modifying the vertical offset ΔZ of the sheets of yarns. Analysis of the pick $d_{n+1}$ makes it possible to determine for each actuator 6 a value dZ, whereby the altitude of the crossing to be applied is modified as a function of the unbalance at the crossing, with this being done by adding an offset value dZ.

Figure 7:
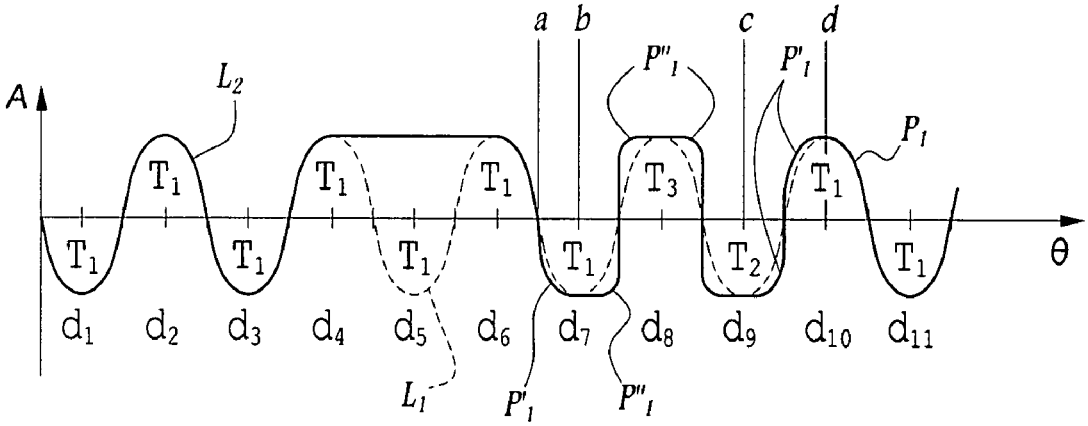
FIG. 7 is a view analogous to FIG. 5, while implementing a third method in accordance with the invention.

In the third embodiment of the invention shown in FIG. 7, account is taken of the warp yarns selected for each pick. This information may form part of the design. It is possible that the characteristics of the warp yarns used from one pick to another vary, in particular when using different warp yarns within a single fabric.

In accordance with the invention, it is possible to modify the shed parameters dynamically as a function of an analysis performed on the type of weft to be made. To make it easy to insert a weft yarn of relatively large diameter, it is necessary to have a shed profile that is very open. Nevertheless, using such a profile significantly increases the risk of breaking warp yarns. The invention makes it possible to diminish this risk.

In the example of FIG. 7, it is assumed that there are three types of profile, i.e. a first type of profile $P_1$ that is substantially sinusoidal, as shown between picks $d_1$ and $d_3$ and aligned on a sinewave $L_1$, a second type of profile $P'_1$ that is wider open than the profile of type $P_1$, and a third type of profile $P''_1$ that is almost rectangular.

Under such circumstances, the weaver has input into a corresponding table the type of profile $P_1$, $P'_1$, or $P''_1$ that corresponds to each type of weft yarn used by classifying the weft yarns by diameter. For example, the fabric might have three types of weft yarn $T_1$, $T_2$, and $T_3$ of diameter that increases from $T_1$ to $T_3$. It is assumed that the weaver allocates the profiles $P_1$, $P'_1$, and $P''_1$ respectively to the weft yarns $T_1$, $T_2$, and $T_3$.

At the beginning of each pick $d_n$, weft analysis is performed by the first computer $C_1$ and serves to select the type of profile that corresponds to the largest-diameter weft yarn that is inserted during the current pick $d_n$ and the following pick $d_{n+1}$. Since the types of profile are defined from one extreme position of the shed to the other, it is appropriate to consider two picks when selecting the profile that is to guarantee the most appropriate weft-passing volume.

Consideration is given to point a at the beginning of pick $d_7$. When the angle θ reaches the value corresponding to this point, the computer $C_1$ analyzes the design that is to be made by taking account of the weft yarns that are to be inserted during picks $d_7$ and $d_8$. If the yarn for insertion in pick $d_8$ is of type $T_3$, whereas the weft yarn to be inserted in pick $d_7$ is of type $T_1$, then the computer determines that the profile to be applied from a point b that is offset from the point a by an angle θ of value 180°, is the $P''_1$ profile type, which corresponds to the largest diameter of the expected warp yarns.

Starting from point b, the computer $C_{21}$ modifies the corresponding actuator control parameters so as to adopt the $P''_1$ profile type over an angular range of 360°.

After pick $d_8$, and insofar as the weft yarns inserted in picks $d_9$, $d_{10}$, and $d_{11}$ are of smaller nominal diameter, the system passes progressively from the $P''_1$ profile type to the $P_1$ profile type, passing via the $P'_1$ profile type that is intermediate between the $P_1$ and $P''_1$ profiles.

At the beginning of pick $d_9$, the computer determines that the profile type to be applied between the points c and d is the $P'^1$ profile type that has been allocated to weft type $T_2$ by the weaver.

In FIG. 7, the types of yarn used are marked diagrammatically at each pick.

In each of the methods described above, it is possible to modify the shed parameters by taking account not only of an analysis produced on the basis of the design to be followed, but also on the basis of external data coming from the loom. For example, in the third method described above, it is possible to take account of the tension in the warp yarns, insofar as relatively high tension in the warp yarns improves decrossing of those yarns, so that it is then not necessary to use profiles that are very marked. Similarly, it is possible to take account of an external parameter that might influence the strength of the yarns, e.g. ambient temperature or humidity.

In the methods envisaged above, the step of modifying the parameter that would normally be determined by the computer is not necessarily performed systematically. dθ may be zero in the first method, and dA can be zero in the second method. In the third method, if there is no need to change the profile type, then the $P_1$ profile type is not modified.

Whatever the embodiment in question, the analysis of the design corresponding to at least one pick makes it possible to consider modifying the value of an actuator control parameter in order to improve the matching of the shed to the intended design, with this being done dynamically and automatically, thus avoiding any need for the weaver to program individually the movement of each of the heddles for each of the picks. The modified parameter(s) can be one or more of the shed parameters Amp, Pc, Pm, Δθ, and ΔZ, as mentioned above.

The technical characteristics of the various embodiments described can be combined with one another in the context of the present invention. The methods described above need be applied for some only of the picks and/or some only of the actuators.

In the meaning of the present invention, a Jacquard loom actuator may control one or more heddles.

The invention claimed is:

1. A device for forming a Jacquard type shed, the device comprising a plurality of electric actuators and control means for controlling the actuators and for generating, for each actuator, a signal representative of a value of at least one parameter determined by a computer on a basis of a weaving design, wherein the control means includes, for at least one actuator:

an analyzer adapted to automatically analyze, for at least one pick of the weaving design, a design corresponding to the at least one pick; and a unit for determining a modification factor on the basis of a result of the analysis carried out by the analyzer, for modifying the value of the parameter determined by the computer.

2. A device according to claim 1, wherein the analyzer analyzes, for at least one pick, the design corresponding to the at least one pick, and also to at least one of an earlier pick and a later pick.

3. A device according to claim 1, wherein the analyzer includes the computer.

4. A device according to claim 1, wherein the unit for determining the modification factor includes the computer.

5. A device according to claim 1, including a memory for storing a parameter depending on the design corresponding to the pick and to at least one of an earlier pick and a later pick.

6. A device according to claim 4, including a memory for storing modification factor values, each of these values being associated with a parameter value determined by the analyzer.

7. A method of forming the shed on a loom for controlling the harnesses of a Jacquard type weaving mechanism according to a weaving design, by means of a plurality of electric actuators controlled by means for generating, for each actuator, a signal representative of a value of a calculated parameter, the method comprising the automatic steps consisting, for at least one pick in:

a) analyzing, for at least one actuator, a design corresponding to the at least one pick; and b) optionally modifying the value of at least one control parameter for controlling the actuator as a function of the result of the analysis of step a).

8. A method according to claim 7, wherein :

c) during step a), the analysis is performed for the design corresponding to the at least one pick and to at least one of an earlier pick and a later pick.

9. A method according to claim 7, wherein :

d) during step a), the design is analyzed for at least one actuator on the basis of high or low positions of a corresponding harness cord, and a parameter is given a value representative of the successive positions of the harness cord; and e) during step b) account is taken of the given value in order optionally to modify the control parameter of the actuator.

10. A method according to claim 9, wherein the value given during step a) is an integer lying in a range 0 to $2^m-1$, where m is the number of picks analyzed during step c).

11. A method according to claim 7, wherein the parameter that is optionally modified affects a crossing angle of the corresponding harness cord relative to a midplane of the shed.

12. A method according to claim 7, wherein:

f) during step a), an unbalance is determined between the high position yarns and the low position yarns in the shed for a later pick, and then a value representative of the unbalance is given to a parameter; and g) during step b), account is taken of the given value to optionally modify the actuator control parameter.

13. A method according to claim 12, wherein the optionally modified parameter affects an amplitude of a displacement (Amp) between the high and low positions of the harness cord driven by the actuator.

14. A method according to claim 12, wherein the optionally modified parameter affects the amplitude of warp yarn crossings relative to a reference plane.

15. A method according to claim 7, wherein:

h) during step a), a type of profile needed for a later pick is determined and a value representative of the type of profile is given to a parameter; and i) during step b), account is taken of the given value to optionally modify the control parameter for the actuator.

16. A method according to claim 15, wherein during step a), the type of profile is determined while taking account of a diameter of the weft yarn to be inserted during the later pick.

17. A method according to claim 15, wherein during step b), account is taken of the value given in order to select the type of profile to be used on the basis of a current pick.

18. A method according to claim 7, wherein during step a), account is taken of a parameter external to the design.

19. A loom (M) fitted with a shed forming device according to claim 1.

20. The method of claim 18 wherein the parameter external to the design is a tension of the warp.

* * * * *